United States Patent [19]

Numata et al.

[11] Patent Number: 5,073,049

[45] Date of Patent: Dec. 17, 1991

[54] PRINT CONTROL FOR DOT MATRIX PRINTER

[75] Inventors: Kunjo Numata, Chigasaki; Noriyasu Niikura; Takemi Kobayashi, both of Hiratsuka, all of Japan

[73] Assignee: NCR Corporation, Dayton, Ohio

[21] Appl. No.: 385,337

[22] Filed: Jul. 24, 1989

[30] Foreign Application Priority Data

Sep. 16, 1988 [JP] Japan ..... 63-230157

[51] Int. Cl.[5] ..... B41J 29/40

[52] U.S. Cl. ..... 400/54; 400/70; 400/76

[58] Field of Search ..... 400/54, 70, 52, 61, 400/76

[56] References Cited

U.S. PATENT DOCUMENTS

| | | | |
|---|---|---|---|
| 4,162,131 | 7/1979 | Carson et al. | 400/124 |
| 4,162,858 | 7/1979 | Brandenburg | 400/124 |
| 4,291,992 | 9/1981 | Barr et al. | 400/124 |
| 4,485,425 | 11/1984 | Gruner | 361/153 |
| 4,486,759 | 12/1984 | Toyomura | 400/120 |
| 4,600,319 | 7/1986 | Everett, Jr. | 400/54 |
| 4,653,941 | 3/1987 | Suzuki | 400/121 |
| 4,713,623 | 12/1987 | Mower et al. | 328/72 |
| 4,780,006 | 10/1988 | Hamano et al. | 400/121 |
| 4,813,802 | 3/1989 | Gilham et al. | 400/120 |
| 4,821,639 | 4/1989 | Carrington et al. | 400/146 |

FOREIGN PATENT DOCUMENTS

| | | |
|---|---|---|
| 0145463 | 8/1983 | Japan . |
| 0049958 | 3/1985 | Japan . |
| 0014969 | 1/1986 | Japan . |
| 0022960 | 1/1986 | Japan . |

*Primary Examiner*—Edgar S. Burr
*Assistant Examiner*—John S. Hilten
*Attorney, Agent, or Firm*—George J. Muckenthaler

[57] ABSTRACT

A print control mechanism for a dot matrix printer for effecting normal printing speed relative to response time of the print elements. The mechanism includes a memory for storing the status of a previous printing operation by one print element prior to a subsequent printing operation by the same print element. The mechanism includes print inhibiting means coupled to the memory and adapted to compare a print command signal with a memory signal and to output a signal forbidding the subsequent printing operation by the same print element when it receives a print command signal following the previous printing operation. The effect of this mechanism is to inhibit continuous printing of dots in very dot position in the lateral direction for those characters which can be printed with dots in every other dot position to enable normal printing speed.

6 Claims, 5 Drawing Sheets

64
Q
F/F
-A
D
62
58
&
60
56
54
=1
72
Q
F/F
-B
70
D
44
46
68
66
48
50
52
PRINTER CONTROLLER
PRINT COMMAND SIGNAL
LATCH SIGNAL B
LATCH SIGNAL A
PRINT OFF SIGNAL

PRINT CONTROL FOR DOT MATRIX PRINTER

BACKGROUND OF THE INVENTION

In the field of printing, the most common type printer has been the printer which impacts against record media that is caused to be moved past a printing line or line of printing. As is well-known, the impact printing operation depends upon the movement of impact members, such as print hammers or wires or the like, which are typically moved by means of an electromechanical drive system and which system enables precise control of the impact members.

In the field of dot matrix printers, it has been quite common to provide a print head which has included therein a plurality of print wire actuators or solenoids arranged or grouped in a manner to drive the respective print wires a very short, precise distance from a rest or non-printing position to an impact or printing position. The print wires are generally either secured to or engaged by the solenoid plunger or armature which is caused to be moved such precise distance when the solenoid coil is energized and wherein the plunger or armature normally operates against the action of a return spring.

It has also been quite common to provide an arrangement or grouping of such solenoids in a circular configuration to take advantage of reduced space available in the manner of locating the print wires in that specific area between the solenoids and the front tip of the print head adjacent the record media. In this respect, the actuating ends of the print wires are positioned in accordance with the circular arrangement and the operating or working ends of the print wires are closely spaced in verticallyaligned manner adjacent the record media. The availability of narrow or compact actuators permits a narrower or smaller print head to be used and thereby reduces the width of the printer because of the reduced clearance at the ends of the print line. The print head can also be made shorter because the narrow actuators can be placed in side-by-side manner closer to the record media for a given amount of wire curvature.

In the wire matrix printer which is utilized for receipt and for journal printing operations, the print head structure may be a multiple element type and may be horizontally disposed with the wire elements aligned in a vertical line and supported on a print head carriage which is caused to be moved or driven in a horizontal direction for printing in line manner across the receipt or journal paper and wherein the drive elements or transducers may be positioned in a circular configuration with the respective wires leading to the front tip of the print head. In the wire matrix printer which is utilized for business forms or like record media printing operation, the print head may be oriented in a manner wherein the nose is pointed downward for printing on the form, slip or like record media while the carriage and print head are moved above and across the form or like record media in the horizontal direction.

Further, in the wire matrix printer which is utilized for receipt, slip and journal printing operations, the individual print heads may be vertically oriented and printing performed by means of the print wires moving downwardly to impact on the record media. Alternatively, the individual print heads may be horizontally oriented and printing performed by means of the print wires moving horizontally to impact on the record media. A preferred number of four of such individual print heads is common in known arrangements.

In the dot matrix printer, there is a requirement for one or more small electric motors to drive certain parts of the printer. A small motor is used to drive the print head carriage in reciprocating manner in the printer that includes a stationary platen and a movable print head. The print head carriage and the associated print head are moved to appropriate and precise locations along the line of printing for dot matrix printing of alpha numeric characters or of graphics type characters. A second motor is used to drive the paper such as a receipt, a slip or a journal at the end of the printing operation and which paper drive is usually performed at the end of each line of printing. However, it is feasible to advance the paper at the end of the printing on a line without the necessity of moving the carriage and print head to the end of such line. This arrangement enables faster printing operation.

The dot matrix printer is commonly used in the form of an output device in computer systems and word processing systems. Dot matrix printers in the form of receipt printers and journal printers are used in an electronic cash register (ECR) or in a point of sale (POS) terminal.

In the dot matrix printer, predetermined characters, letters, symbols or the like are denoted with the use of "M (column) X N (row)" dots which are arranged in a matrix. In this arrangement, the print heads are classed according to the printing method, as solenoid impact type, heat transfer printing type, ink jet printing type, high frequency driving type, and laser beam type print heads.

When dots are printed with use of any of the above-mentioned print head types, the printing speed is determined by the lateral feed speed of the print head. However, it is to be noted that the lateral feed speed cannot be set to a value in excess of the response cycle or time required for driving the print head in a dot printing operation. As a result of this observation, the printing speed is proportional to the response time of the print head and the number of N dots in a row of the character, letter or symbol.

It is also to be noted that a greater number of dots or higher resolution improves the print quality, especially in the printing of Chinese characters. However, in view of the relationship between the printing speed and the print quality, there has been proposed a printing method for balancing these two parameters in the overall printing operation. The proposed printing method provides that, in the case of certain characters and letters, continued printing or printing in each and every dot position in a row is inhibited in order to speed up the lateral feed of the print head. The printing pitch is reduced in the printing of a column or in the slanted or oblique portion of the character to improve the print quality.

Representative documentation in the field of printer control includes U.S. Pat. No. 4,162,131, issued to A. B. Carson et al. on July 24, 1979, which discloses a drive circuit responsive to input pulses to supply drive energy pulses to print heads so as to produce constant impact forces and print intensity by decreasing the energy of the drive pulses as a function of the time interval between successive input pulses below a predetermined time interval.

U.S. Pat. No. 4,162,858, issued to K. Brandenburg on July 31, 1979, discloses a circuit which decides whether or not a magnet has already been actuated during printing of the previous column of the character being printed. When the magnet has not been actuated, a longer pulse or longer amount of energy is provided to the magnet for resonance with printer operation.

U.S. Pat. No. 4,291,992, issued to C. W. Barr et al. on Sept. 29, 1981, discloses a control circuit that generates a firing signal for each print pin comprising a relatively long pulse followed by a series of short pulses. The number of short pulses may be reduced when a successive pulse for the same print pin is received in the interval between the long pulse and completion of the short pulses.

U.S. Pat. No. 4,485,425, issued to M. Gruner et al. on Nov. 27, 1984, discloses a drive circuit for a print element including a drive transistor and a switching transistor each connected to a control transistor that furnishes pulses of different duration such that the switching transistor is turned off before the drive transistor.

U.S. Pat. No. 4,653,941, issued to K. Suzuki on Mar. 31, 1987, discloses a dot matrix printer having first detecting means for detecting the position of the print head, second detecting means for detecting the number of cycles of movement of the print head during printing of a dot pattern for one line, means for judging whether to permit dot printing according to outputs of the two detecting means, and driver means for driving the print head.

U.S. Pat. No. 4,713,623, issued to D. C. Mower et al. on Dec. 15, 1987, discloses a control system wherein a double column of print elements are used and no single print element is required to print more than once in any four column interval of printed text.

And, U.S. Pat. No. 4,780,006, issued to T. Hamano et al. on Oct. 25, 1988, discloses a slip printer wherein the slip is placed in an orientation that is 90 degrees from normal orientation to accommodate slips which are wider than the print station. A pattern processing section is capable of changing the arrangement of the dot pattern depending upon the orientation of the slip.

SUMMARY OF THE INVENTION

The present invention relates to a dot matrix printer for impact printing on record media. The dot matrix printer includes two separate printing stations, one station positioned near the front of the printer and the other station positioned rearwardly of the one station. The two stations are arranged in tandem manner and the two separate print head carriages are coupled to a drum cam type drive mechanism positioned between the two carriages. The two carriages along with the associated print heads are driven by the drum cam type drive mechanism in equal and opposite directions during printing operations.

The one station near the front of the printer is utilized for dot matrix printing on a receipt and on a slip or like business form and is referred to as the receipt/slip station. The other station rearwardly of the one station is utilized for dot matrix printing on a journal and is referred to as the journal station. A plurality of solenoid driven, single wire print heads are supported in spaced relationship on each carriage for performing the printing operations at the two printing stations.

More particularly, the invention is directed to a control system for the dot matrix printer wherein the printing of the dot matrix which constitutes the character or letter is controlled in accordance with the structure of the character or letter and in accordance with inhibiting the printing of certain dots of the matrix.

In the case of a character or letter having a lateral straight line, the printing of a dot at each and every dot position can be adjusted so as to print a dot only at every other dot position. In the case of a character or letter having a slanted or oblique line, each and every dot position can be printed to form the character or letter. The control of the printing operation in this manner can be accomplished without a reduction in lateral print speed and without a reduction in print quality.

In accordance with the present invention, there is provided a control system for a dot matrix printer comprising a plurality of print heads actuated for printing characters in dot matrix manner, control means, memory means for storing the status of a prior printing operation of a print head which is scheduled to perform a printing operation upon receipt of a print command signal from the control means, and print inhibiting means operably associated with said memory means and adapted to compare the print command signal with a memory signal from said memory means to output an inhibit signal to the print head for inhibiting the printing operation of said print head when receiving a print command signal following the previous printing operation by said print head thereby inhibiting continuous printing operation by said print head to enable lateral movement of the print head at a rate faster than the printing cycle of the print head.

In view of the above discussion, a principal object of the present invention is to provide a high speed dot matrix printer.

Another object of the present invention is to provide a dot matrix printer having a control system for printing only in certain dot positions in forming a dot matrix character.

An additional object of the present invention is to provide a dot matrix printer which prints only certain dot positions in lateral dot lines and which prints at all dot positions in oblique dot lines.

A further object of the present invention is to provide a control system for a dot matrix printer having control means and memory means which includes print inhibiting means adapted to compare a print command signal with a memory signal and to output a signal to the control means to inhibit a particular printing operation.

Additional advantages and features of the present invention will become apparent and fully understood from a reading of the following description taken together with the annexed drawing.

DESCRIPTION OF THE PREFERRED EMBODIMENT

Figure 1:
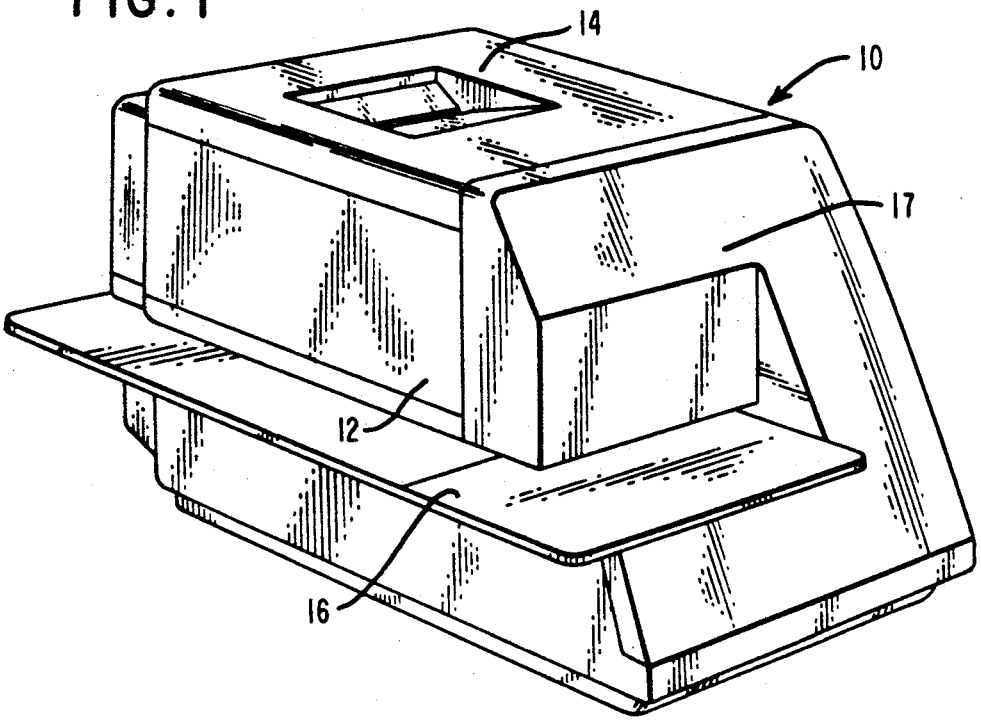
FIG. 1 is a perspective view of a dot matrix printer incorporating the subject matter of the present invention.

Referring now to FIG. 1, a printer 10 is designed as a two station, receipt/slip and journal printer. The receipt/slip printing station occupies a front portion 12 and the journal printing station occupies a rearward portion 14 of the printer. A slip table 16 is provided along the left hand side of the printer 10. A front cover 17 swings toward the right to expose certain operating parts of the printer 10.

Figure 2:
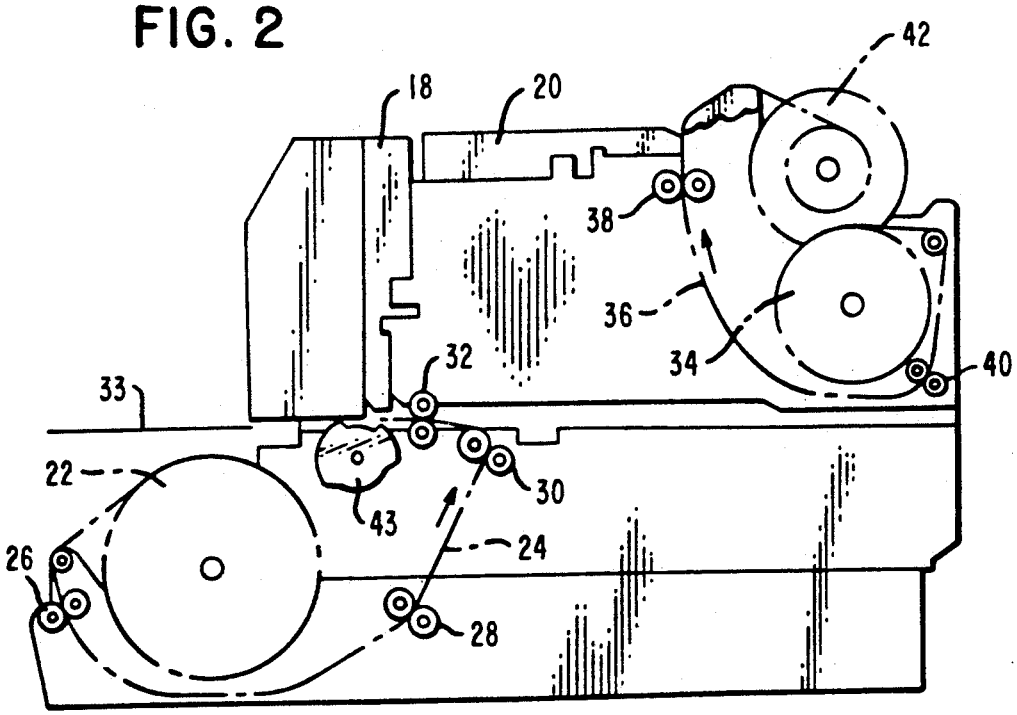
FIG. 2 is a right side elevational view in diagrammatic form showing the arrangement of certain elements of the printer.
Figure 3:
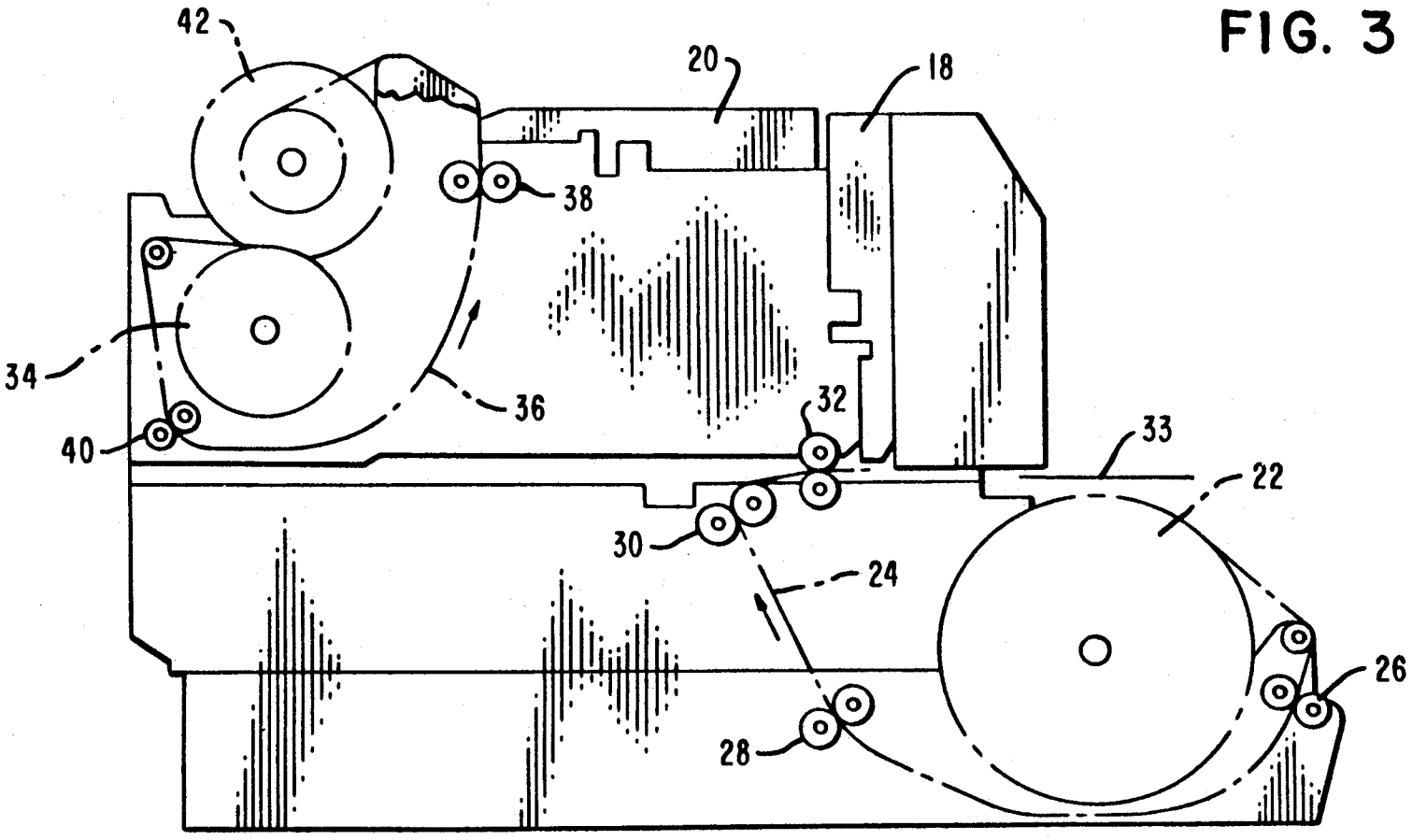
FIG. 3 is a left side elevational view in diagrammatic form showing the arrangement of such certain elements of the printer.

FIGS. 2 and 3 are right and left side elevational views and show certain elements of the printer 10 in diagrammatic form. The receipt/slip portion 12 and the journal portion 14 include individual print wire solenoids (not shown) along with a ribbon cassette 18 for the receipt/slip printing station operation and a ribbon cassette 20 for the journal printing station operation. A roll 22 of receipt paper is journaled at the front of the printer 10 and the receipt paper 24 is driven and guided by appropriate pairs of rollers, as 26, 28, 30 and 32 in a path past the receipt/slip printing station for printing operation and for issuance of a receipt 33 after cutting thereof from the receipt paper 24. A supply roll 34 of journal paper is positioned in a suitable cradle at the rear of the printer 10 and the journal paper 36 is driven and guided by appropriate pairs of rollers, as 38 and 40, in a path from the supply roll 34, past the journal printing station, and onto a take-up roll 42. A timing plate 43 (FIG. 2) is provided at the receipt/ slip printing station for positioning the receipt/slip feed rolls.

Figure 4:
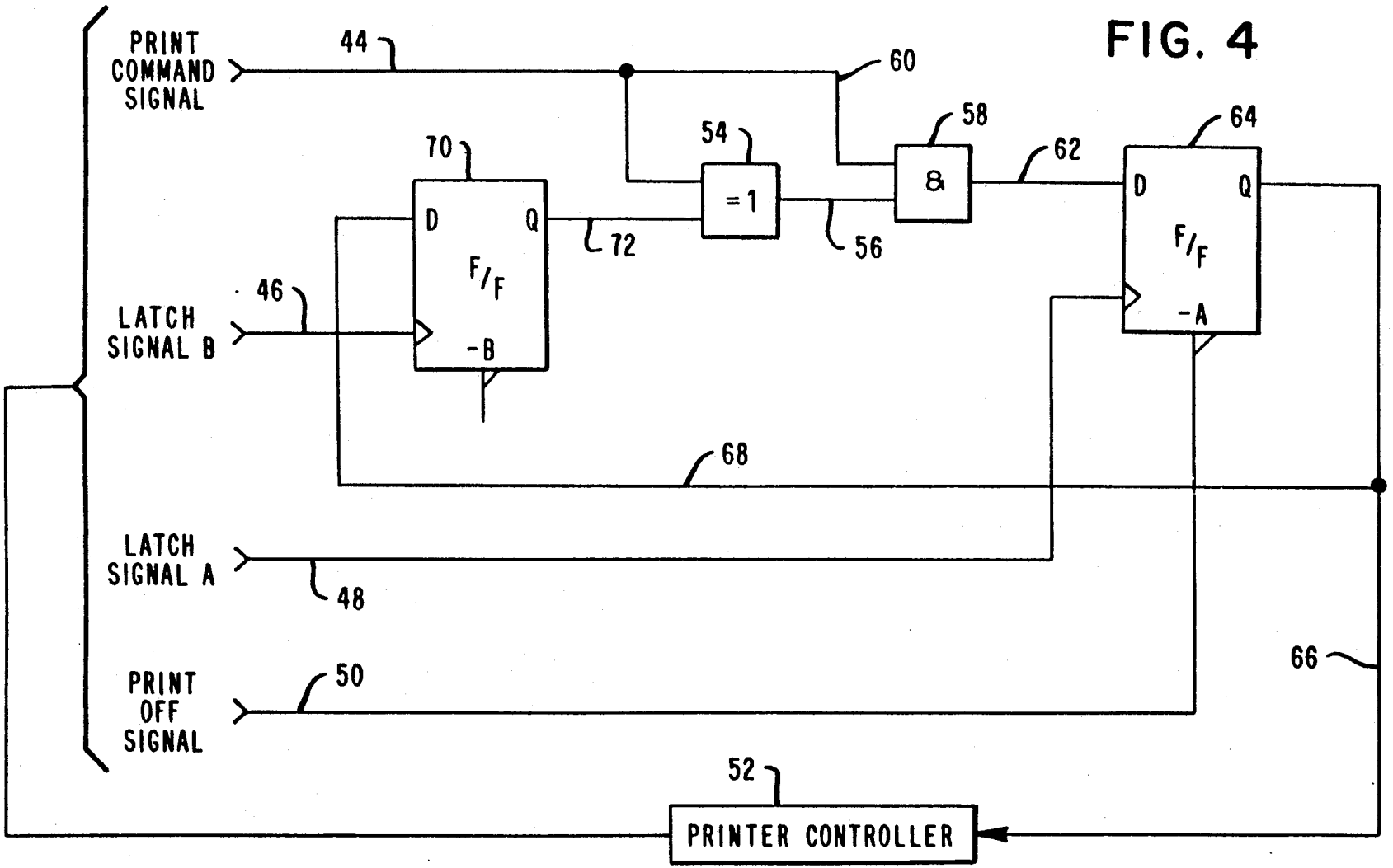
FIG. 4 is a circuit diagram of a preferred embodiment of the present invention.

FIG. 4 is a control circuit that is used in the print control arrangement of the present invention. This control circuit is provided for each print head (not shown) used in the printer 10. The preferred embodiment of the printer 10 uses six single wire solenoids arranged in a row on a print head carriage (not shown) and driven in transverse manner across the printer 10 in printing operations. A set of six solenoids is provided for the journal printing station and a set of six solenoids is provided for the receipt/slip printing station. A disclosure of the six solenoids and the carriage therefor is fully described and shown in a copending application, Ser. No. 385,333.

A plurality of input leads 44, 46, 48 and 50 are connected to a printer controller 52. A printer controller of the type required for dot matrix printing is known by one skilled in the art. A logic level high signal ("1") is input from the printer controller 52 via lead 44 to an exclusive OR gate 54. An output signal of exclusive OR gate 54 is sent over lead 56 to one input terminal of an AND gate 58.

In the situation wherein a selected or certain print head has not been actuated in a previous printing operation, a level "1" (high) signal is input via lead 60 to the other input terminal of the AND gate 58. The AND gate 58 outputs a level "1" signal over lead 62 to a flip-flop 64. The flip-flop 64 latches the signal which is input from the AND gate 58 in accordance with a latch signal A sent via lead 48 from the printer controller 52 to generate a level "1" signal from an output terminal Q of the flip-flop 64. The output signal of flip-flop 64 is sent over lead 66 to the printer controller 52. When the flip-flop 64 outputs a level "1" signal over the lead 66, a printing operation is allowed and performed. When the flip-flop 64 outputs a level "0" signal over lead 66, a printing operation is inhibited. In this regard, the output signal of the flip-flop 64 determines a print operation or a print inhibiting operation.

In the first situation wherein a printing operation is allowed and performed, the flip-flop 64 outputs a level "1" or high signal thereby enabling the performing of the printing operation by a designated print head. The high level signal from the flip-flop 64 is also input via lead 68 into a flip-flop 70 which latches the high level signal with a latch signal B via lead 46 from the printer controller 52 and generates a level "1" signal from an output terminal Q of the flip-flop 70.

In the situation wherein print signals are successively input from the printer controller 52 to the same designated print head, although a print command or instruction signal is sent from the printer controller 52 over the line 44 to the exclusive OR gate 54 in the same manner as described above, an output signal from flip-flop 70 over lead 72 is at level "1" or high, so that the exclusive OR gate 54 outputs a logic level "0" (low) signal. The low level signal from the exclusive OR gate 54 is then input via lead 56 into the AND gate 58. The AND gate outputs a low level signal which is input into the flip-flop 64, the output of which goes low with the receipt of the latch signal A via lead 48 from the printer controller 52. The low level output signal from the flip-flop 64 is sent to the printer controller 52 via lead 66 to inhibit the actuation of the designated print head. Accordingly, the continuous actuation of this print head is avoided in the printing operation.

The low level output signal from the Q terminal of flip-flop 64 is also input via lead 68 into the flip-flop 70, and the output thereof goes low with the receipt of the latch signal B via lead 46.

When the next print command signal over line 44 from the printer controller 52 is at the high level, the output signal from the exclusive OR gate 54 goes high and a printing operation is permitted. When drive command signals are output from the printer controller 52 for printing three dots in continuous or successive manner, the command signal for printing the intermediate dot is inhibited. In order to keep the output time of a high level signal from the flip-flop 64 at a specified and predetermined length of time, a print off signal is sent via lead 50 into a reset input terminal of the flip-flop 64.

It is thus seen that the flip-flop 70 stores a dot having been printed in a previous column to the right and that the flip-flop 64 provides a print inhibiting signal for the next successive dot to be printed to the right, the printing being performed in the left to right direction.

In the situation wherein the output signal from flip-flop 70 is low, a high print command signal to one input of the exclusive OR gate 54 along with the low output signal of flip-flop 70 causes the exclusive OR gate 54 to output a high signal to the AND gate 58. The AND gate 58 then outputs a high signal to the D input of the flip-flop 64 which, in turn, outputs a high level print inhibiting signal to a D input of the flip-flop 70 to be set or stored therein. Therefore, when a dot printing operation has been performed, the flip-flop 64 cannot be set for the dot to be printed in the next successive column because the output signal of flip-flop 70 is high and causes the output of the AND gate 58 to be low. Accordingly, flip-flop 64 cannot be set at the time of receiving the latch signal A and the output signal of flip-flop 64 is low which inhibits printing a dot in the next column position.

Figure 5:
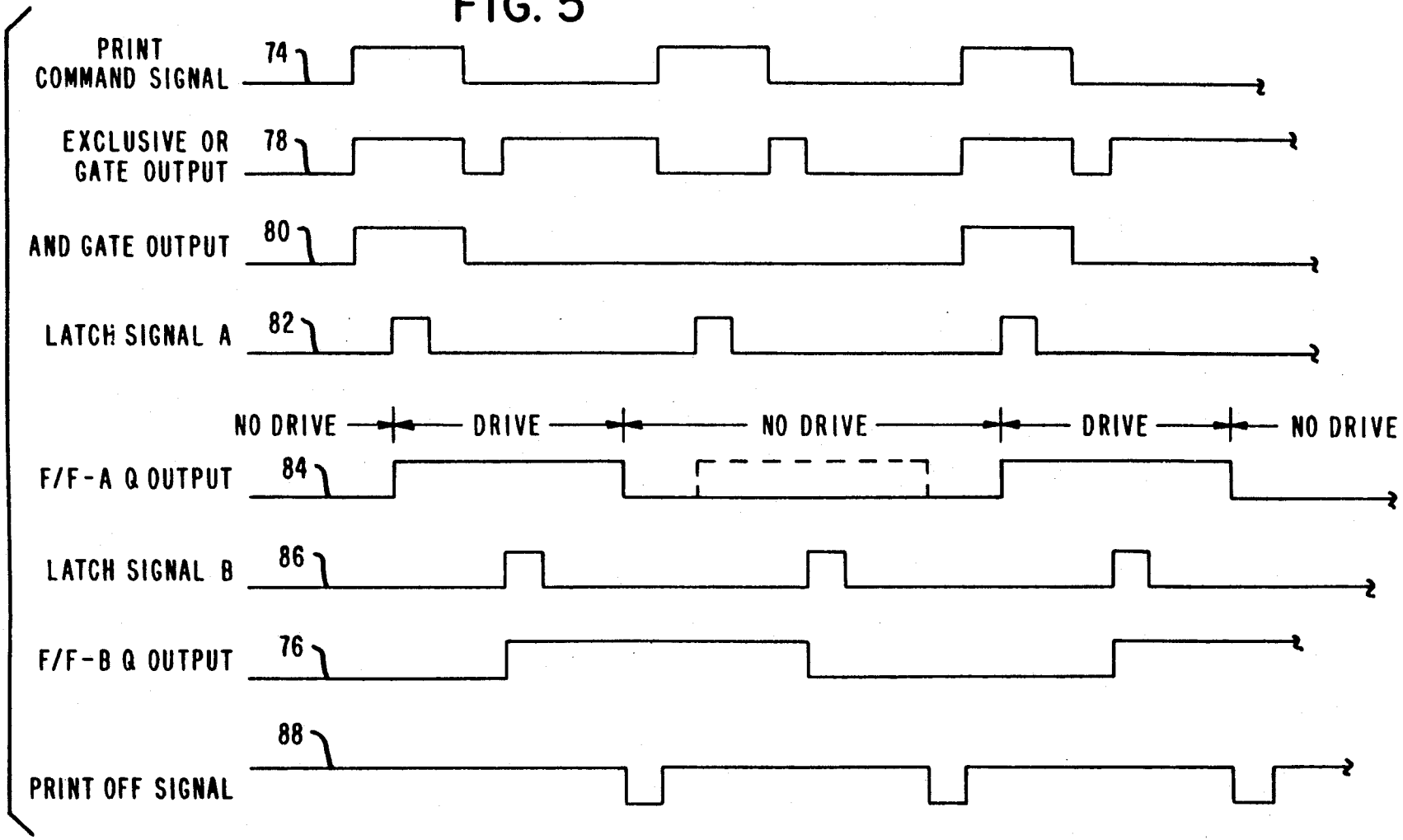
FIG. 5 is an illustration showing voltage waveforms of individual signals when print command data are input three successive times.

FIG. 5 is a timing chart showing voltage waveforms of the individual signals illustrated in the control circuit of FIG. 4. First described is the case wherein a print command signal represented by waveform 74 is input on lead 44 at a high level. If the previous printing operation has not been performed, the output signal from flip-flop 70 represented by waveform 76 is at low level and the output from the exclusive OR gate 54 represented by waveform 78 goes high. As a result, the AND gate 58 outputs logic $1+1=1$ and a high signal represented by waveform 80 is input into the flip-flop 64 at terminal D. This situation is read into the flip-flop 64 at the rise of the latch signal A represented by waveform 82 and the output signal of flip-flop 64 represented by waveform 84 via line 66 simultaneously goes high to perform a printing operation. During the dot printing operation, the output signal 84 is read into the flipflop 70 at the rise of the latch signal B represented by waveform 86 and a high level signal 76 is output via line 72 to the exclusive OR gate 54. This output signal is maintained until the next rise of the latch signal B. As described above, the output signal for printing a dot is read into the flip-flop 70 in the form of the latch signal A (waveform 82) and then is reset at the rise of a print off signal (logic "0") represented by waveform 88 after the appropriate passage of the specified and predetermined length of time.

The output signal (waveform 76) of the flip-flop 70 is normally maintained at a high level. However, when the print command signal represented by waveform "1" is again input over line 44, the two input signals represented by waveform 74 and 76 of the exclusive OR gate 54 go high. As a result, the output signal 78 of the exclusive OR gate 54 goes low and the output signal 80 of the AND gate 58 also goes low. This low signal is again read into the flip-flo,p 64 in accordance with the latch signal represented by waveform A. Therefore, in spite of the fact that the dot printing command signal is at the high level ("1"), the print drive signal 84 goes low ("0") to inhibit the continuous dot printing operation by the designated print head in the lateral direction. The low level signal 84 is again read into the flip-flop 70 at the rise of the latch signal A and resets the flip-flop 70 to logic "0". As a result, the output signal 76 from flip-flop 70 over line 72 goes low and this low signal is input into one terminal of the exclusive OR gate 54. The next print driving command signal is output from the printer controller 52 to permit the printing operation.

Figure 6:
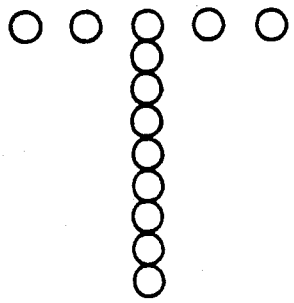
FIG. 6 shows an example of inhibited dot printing of the letter T.
Figure 7:
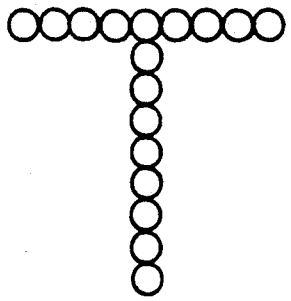
FIG. 7 shows an example of uninhibited dot printing of the letter T.
Figure 8:
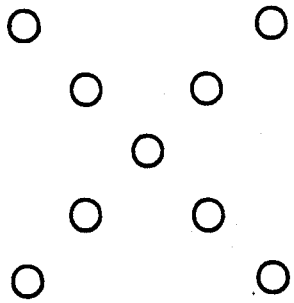
FIG. 8 shows an example of inhibited dot printing of the letter X.
Figure 9:
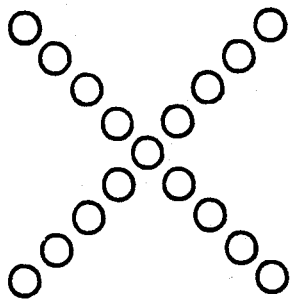
FIG. 9 shows an example of uninhibited dot printing of the letter X.

FIGS. 6 and 7 show printed examples of letter matrices of patterns for the letter T including a column of dots and a row of dots in straight lines. FIGS. 8 and 9 show the letter X including dots in oblique straight lines. FIGS. 6 and 8 show examples of printing in every other dot position whereas FIGS. 7 and 9 show examples of printing in all dot positions.

It is seen that in FIG. 6, wherein printing is performed in every other dot position in the lateral direction, the letter T can be readily identified. However, in FIG. 8, wherein printing is performed in every other dot position, the letter X is not as easily identified. Since it is difficult to recognize the letter X by printing every other dot position along the oblique straight lines (FIG. 8) with print head movement in the lateral direction, it is advantageous to print in all dot positions, as illustrated in FIG. 9.

In order to ensure good print quality, it is preferable to print all dots, however, the lateral speed of the print head should be reduced to about one-half speed from the speed used in printing the lateral line in FIG. 6 due to the relationship of the lateral speed to the response speed of the print head. In the case of printing the letter X, as shown in FIG. 9, and when printing all the dots in the oblique straight lines, the same print head does not continuously print dots, so there is no requirement to slow the lateral speed of the print head. In this respect and unlike the situation shown in FIG. 6, the relationship between the lateral speed of the print head and the response time of the print head need not be considered.

The present invention provides print inhibiting means and storage means for storing a dot to be printed in order to prevent the next adjacent dot in a row of consecutive dots from being printed by means of gating the next adjacent dot with the stored dot.

It is apparent from the above description that a letter T can be read even when the lateral line of dots is printed in every other dot position and that all dots of a letter X can be printed in an oblique straight line without slowing the printing speed. Therefore, the continuous dot printing in the lateral direction is inhibited and continuous dot printing in oblique directions is allowed to provide high speed printing and to still maintain print quality.

The designer or manufacturer of the character font of a continuously printed letter or character in the lateral direction takes into account the inhibiting of continuous dot printing in such direction. A user of the character font may desire to change the printing format and attempt to obtain better print quality by continuous dot printing in the lateral direction. If the speed of the print head is not associated with the response time, the printing may be smeared by rubbing the paper, the print quality is lowered and the print element may be damaged. It is seen that when such matters occur and are not remedied, the printer may incur vibration and thus effect the printing operation. The relationship between the speed of the print head and the response time of such print head in actuating the print pin or wire, the printing of a dot, and the returning of the print pin or wire to its original position is extremely important to obtain good quality printing.

The present invention solves the abovementioned problems by providing control of the printing operations with memory means for storing the presence and the absence of a printing operation which has been previously performed for each print head. Print inhibiting means is adapted to compare a print command signal for each print head with a memory signal in the memory means to output a print inhibiting signal when the print command signal is continuously output to the same print head three times for printing three dots. The present invention provides a method and apparatus for controlling the driving of print heads wherein continuous printing of dots in every dot position in the lateral direction is automatically avoided. The method and apparatus for controlling the printing operation is also applicable in a thermal printer and in an ink jet printer.

It is thus seen that herein shown and described is a control arrangement for dot matrix print heads wherein the print pitch (the distance between dots) is reduced upon printing dots arranged in columns or arranged in oblique direction to ensure good print quality. The continuous printing of dots in rows in each dot position in the lateral direction is inhibited in order to increase the lateral speed of the print heads.

A high speed printing operation is realized while maintaining the print quality at or above a certain level even though the font designs or arrangements for printing letters, characters or symbols were prepared in error so as to continuously print dots in a row. The continuous dot printing is automatically inhibited by the present invention and deterioration of print quality and damage to the print head pin or wire is avoided.

The apparatus and arrangement enable the accomplishment of the objects and advantages mentioned above, and while the preferred embodiment of the invention has been disclosed herein, variations thereof may occur to those skilled in the art. It is contemplated that all such variations not departing from the spirit and scope of the invention hereof are to be construed in accordance with the following claims.

What is claimed is:

1. Print control mechanism for a dot matrix printer having a printer controller and a plurality of single element print heads wherein the speed of lateral movement of the print heads is faster than the printing cycle response time of the print heads to inhibit continuous printing by at least one of said print heads while enabling high speed in printing operations, said mechanism comprising:

memory means comprising a first flip-flop for storing the status of a printing operation by said at least one print head which printing operation has been performed immediately prior to a subsequent printing operation which is scheduled to be performed, and printing inhibiting means including a second flip-flop coupled to said first flip-flop for comparing a print command signal from said printer controller with a memory signal from said first flip-flop, said second flip-flop outputting a high level signal for a predetermined period of time as set by a print off signal from said printer controller to said second flip-flop for a printing operation upon input of a first latch signal from said printer controller into said second flip-flop, and said second flip-flop outputting a low level signal upon input of a second latch signal into said first flip-flop and upon receipt of a low level signal from said first flip-flop by said second flip-flop to output to the printer controller a signal for inhibiting the subsequent printing operation by said one print head when said one print head receives a print command signal for another printing operation following the performed printing operation whereby continuous printing operation by said one print head is inhibited dependent upon the low level output signal of said second flip-flop to said printer controller.

2. The print control mechanism of claim 1 wherein said memory means includes a flip-flop coupled to an exclusive OR gate, and an AND gate coupled to said exclusive OR gate and to said printing inhibiting means and gating the printing signal for the subsequent printing operation to the printer controller.

3. The print control mechanism of claim 1 wherein the printing inhibiting means is actuated at every other dot position to prevent continuous printing of dots in the lateral direction.

4. In a dot matrix printer having a plurality of single element print heads and a printer controller for controlling actuation of each of the print heads, the improvements comprising memory means comprising a first flip-flop for storing the status of a printing operation by at least one print head which printing operation has been performed immediately prior to a subsequent printing operation which is scheduled to be performed, and printing inhibiting means including a second flip-flop coupled to said first flip-flop for comparing a print command signal from said printer controller with a memory signal from said first flip-flop, said second flip-flop outputting a high level signal at a specified and predetermined length of time as set by a print off signal from said printer controller to said second flip-flop for a printing operation upon input of a first latch signal from said printing controller into said second flip-flop, and said second flip-flop outputting a low level signal upon input of a second latch signal into said first flip-flop and upon receipt of a low level signal from said first flip-flop by said second flip-flop to output to the printer controller a signal for inhibiting the subsequent printing operation by said one print head for a predetermined period of time when said one print head receives a print command signal following the performed printing operation whereby continuous printing operation by said one print head is inhibited dependent upon the low level output signal of said second flip-flop to said printer controller.

5. In the dot matrix printer of claim 4 wherein said memory means includes a flip-flop coupled to an exclusive OR gate, and an AND gate coupled to said exclusive OR gate and to said printing inhibiting means and gating the printing signal for the subsequent printing operation to the printer controller.

6. A method for inhibiting continuous printing by at least one of a plurality of dot matrix print heads in a printer having a printer controller while enabling high speed in printing operations, comprising the steps of:

storing the status of a printing operation by said at least one print head in a first flip-flop and which printing operation has been performed immediately prior to a subsequent printing operation which is scheduled to be performed, and inhibiting continuous print by said at least one print head upon comparing in a second flip-flop a print command signal from said printer controller with a memory signal from said first flip-flop upon receipt of a first latch signal from said printer controller and outputting to the printer controller a high level signal for a predetermined length of time as set by a print off signal form said printer controller for a printing operation, and upon receipt of a low level signal and a second latch signal from said first flip-flop, outputting to the printer controller a low level signal for inhibiting the subsequent printing operation by said at least one print head for a predetermined period of time when said one print head receives a print command signal for another printing operation following the performed printing operation whereby continuous printing operation by said one print head is inhibited dependent upon the low level output signal of said second flip-flop to said printer controller.

* * * * *